US011779065B2

(12) United States Patent
Cendales Miguez

(10) Patent No.: US 11,779,065 B2
(45) Date of Patent: Oct. 10, 2023

(54) FUNCTIONAL TEXTILE FABRIC

(71) Applicant: Grupo Textil Providencia, S.A. de C.V., Tlaxcala (MX)

(72) Inventor: Rafael Enrique Cendales Miguez, Tlaxcala (MX)

(73) Assignee: Grupo Textil Providencia, S.A. de C.V., Tlaxcala (MX)

( * ) Notice: Subject to any disclaimer, the term of this patent is extended or adjusted under 35 U.S.C. 154(b) by 451 days.

(21) Appl. No.: 16/858,829

(22) Filed: Apr. 27, 2020

(65) Prior Publication Data

US 2021/0321695 A1 Oct. 21, 2021

(30) Foreign Application Priority Data

Apr. 16, 2020 (MX) ..... MX/a/2020/003623

(51) Int. Cl.

| | |
|---|---|
| ***A41D 13/11*** | (2006.01) |
| ***D06M 16/00*** | (2006.01) |
| ***D06P 5/00*** | (2006.01) |
| *D06P 5/24* | (2006.01) |

(52) U.S. Cl.

CPC ..... *A41D 13/1192* (2013.01); *D06M 16/00* (2013.01); *D06P 5/003* (2013.01)

(58) Field of Classification Search

CPC ..... A41D 13/1192; D06M 16/00; D06P 5/003
See application file for complete search history.

(56) References Cited

U.S. PATENT DOCUMENTS

| | | | | |
|---|---|---|---|---|
| 4,812,357 | A | 3/1989 | O'Rell et al. | |
| 5,364,683 | A | 11/1994 | Flint et al. | |
| 6,207,250 | B1 | 3/2001 | Bullock et al. | |
| 2015/0217553 | A1 | 8/2015 | Bowser | |
| 2021/0062411 | A1* | 3/2021 | Nam | D06M 11/83 |
| 2021/0235791 | A1* | 8/2021 | McEntire | B01D 39/1623 |

FOREIGN PATENT DOCUMENTS

| | | |
|---|---|---|
| CN | 1558016 | 1/2006 |
| CN | 100359080 | 1/2008 |
| MX | 2013012016 | 4/2015 |
| MX | 2013012017 | 4/2015 |
| MX | 2015005605 | 11/2016 |

* cited by examiner

*Primary Examiner* — Amina S Khan
(74) *Attorney, Agent, or Firm* — Defillo & Associates, Inc.; Evelyn A. Defillo

(57) ABSTRACT

The present invention refers to a method for manufacturing a functional textile product with microbicidal activity, which can preferably have a text or image in color or black and white printed on it, which is aimed at solving the problem of impregnating and fixing a microbicidal solution in simple steps and without the use of fixing or dispersing chemicals, and in another aspect that the textile fabric may also have a predetermined digital image on the surface thereof, where the image has definition, contrast and durability of the print without neglecting or affecting the microbicidal activity on the textile substrate. Preferably, without intending to limit the scope of the invention, the functional textile woven material may be bed linens such as covers, duvets and the like, clothing, articles for hospitals or the health sector, such as face covers, the industrial sector, food or any other sector that requires contagion prevention devices.

6 Claims, 2 Drawing Sheets

FUNCTIONAL TEXTILE FABRIC

TECHNICAL FIELD

The present invention belongs to the technical field of the textile industry, especially that of the textile industry, hygiene, and human health. Particularly to the technical field of the treatment of textiles or the like and more particularly to the technical field of the treatment of fibers, threads, yarns, fabrics, or fibrous products with substances that show microbicidal properties.

BACKGROUND

In recent years, it has been sought to treat textile fabrics to provide them with desired properties, such as stain resistance, water repellency and, for the case of the present invention, resistance to microbial growth. The textiles that receive these treatments are functional textiles, that is, functional textiles are those with properties that give them certain functionality. Said textiles, therefore, acquire their functionality due to the characteristics of the material applied on it. The efficient functionality of these products has been demonstrated in various works, which has increased their demand in the medical area, by hospitals or sectors that require providing this property in fabrics, using these textiles as a barrier to decrease the spread of infections.

There are various techniques used to provide microbicidal functionality, mainly the incorporation of nanomaterials on textile substrates. Depending on the step of the process, textile in which the materials are incorporated, two main types of application can be distinguished: incorporation during the spinning process or deposition in the finishing process of the fabric. One proposal is made by the Mexican application MX 2015005605 (A), which describes a biosynthesis process of silver nanoparticles, which uses latex from Jatropha curcas, the latex functionalizes the surface of the silver nanoparticles during synthesis, which allows its attachment to cotton garments providing the same antibacterial properties. The process for incorporating the silver nanoparticles into cotton garments consists of introducing the cotton fabric in a solution that comprises a solution of Jatropha curcas latex and silver salts.

A stain repellent antimicrobial fabric is disclosed in U.S. Pat. No. 6,207,250 (B1). In this patent, the textile is treated with at least one composition comprising an antimicrobial agent and a fluorochemical composition is applied to a fabric such as a jacquard, to produce a treated fabric. Stain and liquid resistant, antimicrobial fabric essentially retain its natural texture, is durable and easy to handle.

For its part, the Chinese application CN 1558016 (A) refers that the nano-silver antibiotic tissue is prepared with a material that includes silver nitrate, hydrazine hydrate, polyglycol and surface aid, and makes the nanoplate adhere to the surface of and between the fibers of the fabric. The nano-silver antibiotic tissue has a silver loading amount of between 0.1-500 mg/m$^2$, and the silver grains are 10-100 nm in size and are homogeneously distributed in the tissue with high adhesion. The tissue can be of Cotton, silk, wool, chemical fiber, and mixed fiber, as a disadvantage of this technology, it is necessary to "recharge" with silver after each wash.

Another proposal defined in Chinese patent CN 100359080 (C) describes a finishing method for nanometric antibiotic tissue. By means of sol-gel technology; The silica gel is prepared on fabric with a container with different modules, which contains water as a precursor and ammonium salt as a catalyst and the filler fabric is used to introduce silver antibiotic and endow the fabric with an excellent long-lasting antibiotic performance. The results of the tests indicate that the fabric presents 99% death on *colibacillus* and *Staphylococcus aureus*. Another case cited is the chinese invention patent "Preparation method for nano silver-containing antibacterial tissue CN 1558016 (A) which describes a method for preparing nano-silver-containing antibacterial textiles, using silver nitrate, hydrazine hydrate and polyethylene glycol as materials raw materials, and adds surface additives of nanoplate that binds between the fibers of washed fabrics and the surface of fabrics, and the nanoplate-loaded antibacterial textile is obtained after drying. The silver charge is 0.1 to 500 mg Ag/m^2, and the silver particle size is 10 to 100 nm Silver nanoparticles are evenly distributed in textiles.

Now, regardless of the process used to functionalize a textile, the microbicidal finishing of textiles with nanomaterials still faces various technical problems that need to be resolved before this textile functionalization can be implemented at an industrial level, some of the problems as persistent are the selection of a suitable dispersing agent to prevent agglomeration of nanoparticles, a suitable reducing agent to reduce nanoparticle ions, for textile finishing, a suitable binder must be selected to fix the nanoparticle antibacterial agent in the textile, the apparent selection of these components seems simple, however, the person skilled in the art should consider that these compounds or their combinations, in addition to fulfilling their role in the process, must also be appropriate so as not to significantly alter the properties of textiles, for example, should not "alter" the feel of the fabric, the ability to wash nanoparticles on the surface of textiles; and especially a desired approach in the present invention, it is highly desirable to avoid fading of textiles.

The current demand for new functional textile products has forced manufacturers to develop new products that not only meet microbicidal functionality, but also add color and design to make them more attractive. New printing techniques and systems have recently emerged and are being developed, for example, proposals have been made to print products from electronic source files that can be processed directly on the printing press or inkjet printing system. These processes have been tried with modest success on surfaces such as vinyl, but successful printing on textile surfaces has been even more limited.

In this sense, some state-of-the-art documents describe some technologies aimed at providing a solution to digital printing on textiles, such is the case of the US patent application U.S. Pat. No. 4,812,357 (A) where reference is made to a blanket of printing having a printing blanket with dimensional stability, compressibility and web feed properties comprising a casing, a compressible layer covering the casing, a stabilizing layer of reinforced thermoplastic elastomer covering the compressible layer and a surface layer of rubber print without gaps where it also has a thermoplastic reinforced elastomer that is formed by thermoplastic fibers or fibrils dispersed throughout the elastomer. Preferably the thermoplastic melts when mixed with the elastomer to provide exceptionally fine and well dispersed fibrils.

In the same sense, a printing blanket and its manufacturing method is described in the US patent application U.S. Pat. No. 5,364,683 (A), where it is laminated with multiple layers for use in offset printing, comprising in order a first layer of compressible fabric, one layer of compressible elastomer, at least two additional layers of fabric placed on top of the compressible elastomer layer, an elastomeric sub-level and an elastomer print face deposited by a solvent-free process and with a surface profile adapted to reduce gain of dots while improving the release capacity of printed matter. At least the lowest fabric layer incorporates a protective coating to prevent the absorption of inks, water and/or solvents through the blanket, which could otherwise cause swelling and delamination of the different layers.

A print-on-demand method of creating the top layer of a quilt or the like is extensively described in the application US 20150217553 (A), which uses a computer, software program to create a desired design that prints directly onto multiple sheets of cloth. The sheets are formulated to retain the printed design and have a rigid liner for easy printing by using a standard consumer desktop printer. The sheets are strategically positioned, joined, and cut to form the top layer of the desired quilt.

Also known are patent applications MX 2013012016 (A) and MX 2013012017 (A), which describes a system and method for printing high-resolution images on textile material, preferably bedding such as sheets and pillowcases, using an improved sublimation technique, where an arrangement of color profiles is generated in printers in terms of pre-sublimation printing and in the sublimation process to be able to choose economic inks and transfer paper of better quality and pressure that offer excellent sublimation results and where the equipment that allows perfecting the sublimation consists of a calender with a heat-emitting cylinder heated by recirculating hot oil to generate high constant and uniform temperatures on the entire surface of the cylinder; reason why the combination of this innovation plus the use of high temperatures, allows a better transfer of the ink it has a solid to gaseous state, as well as achieving brighter colors that in turn enhance the quality of the images, achieving high definition images of 720 dpi up to 1440 dpi in the textile material.

However, textile products with printed images are not functional, which creates the need to provide a functional textile with microbicidal properties, which has an image printed on it, but meets the desired conditions, such as dispersion of the nanoparticulate material, its durability even after washing, avoid chemicals to fix and disperse nanoparticles.

OBJECT OF THE INVENTION

It is, therefore, that the present invention aims to provide a method for making a functional textile fabric with microbicidal activity without the use of fixing agents, impregnating agents, dispersing agents, binders or any other chemical product for this purpose.

A further object is to provide a method of making a functional textile fabric with reusable microbicidal activity, even and after one or more washes.

Another object of the invention is aimed at providing a method to improve the sharpness and stability of prints on a functional textile fabric with microbicidal activity with a high definition image print without loss of details.

Another objective of the invention is to allow the method to confer functional textile fabric with microbicidal activity in high definition images, which also allows achieving optimum sharpness in the printed images, achieving better color, definition and innumerable personalized designs, with a realism as if a high-quality photograph was being stamped on it, without losing the microbicidal properties.

Another object of the invention is aimed at providing a method to improve the sharpness and stability of prints by digital printing on functional textile fabric with microbicidal activity, which also allows to significantly reduce the costs associated with microbicidal activity and printing or stamping to industrial production, through a continuous production process.

Another object of the invention is aimed at providing a method to improve the stability of the microbicidal material and the image on functional textile fabric by penetrating the materials into the fabric, which allows it to remain on the fabric, being able to wash it without fading or discoloring, likewise, the proposed method allows nanoparticles with microbicidal activity to remain on the polyester microfibers without altering their activity.

Still another object of the invention refers to a textile product obtained according to the method of the invention, made of functional textile fabric with microbicidal activity and, where appropriate, with a digital printing pattern, where said textile has greater color penetration into its fibers, a homogeneous dispersion of nanoparticles and fixation without any chemical agent for this purpose.

The objectives of the present invention referred to above and still others not mentioned, will be evident from the description of the invention and the figures that accompany it by way of illustration and not limitation, which are presented below.

DESCRIPTION OF THE INVENTION

Figure 1:
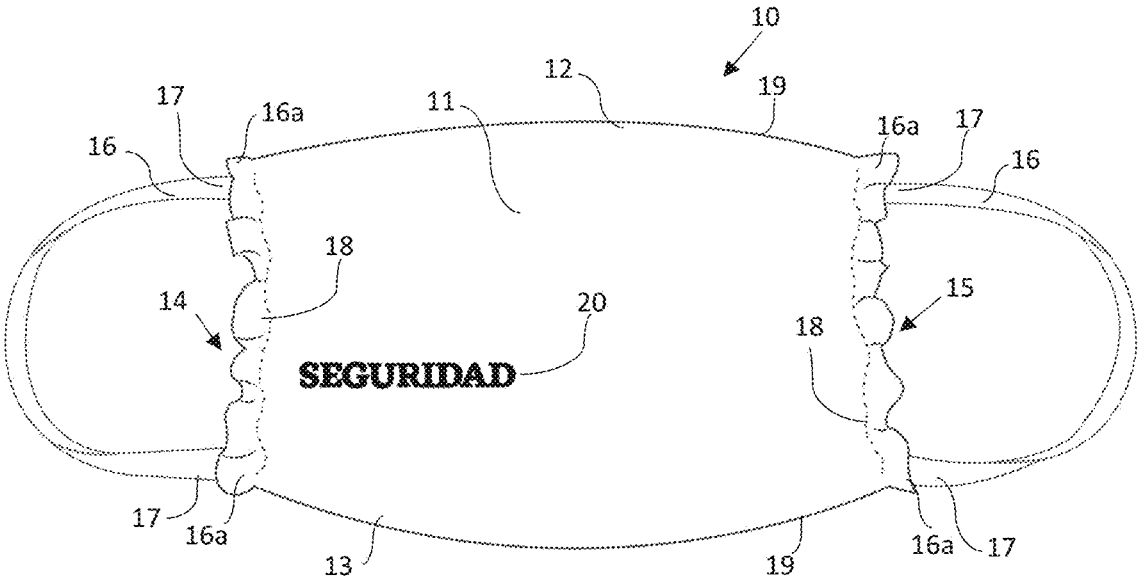
FIG. 1 shows a mask (10) with letters printed on the functionalized textile fabric.

The present invention refers to a method for manufacturing a functional textile product with microbicidal activity, which preferably has a color or black and white image printed on it, which is aimed at solving the problem of impregnating and fixing a microbicidal solution in simple steps and without the use of fixing or dispersing chemicals, and in another aspect that said textile fabric may also have a predetermined digital image on its surface, where said image has characteristics of definition, contrast and durability of the printing without neglecting or affecting the microbicidal activity on the textile substrate. Preferably, without intending to limit the scope of the invention, the woven material may be bed linens such as covers, duvets and the like, clothing, articles for hospitals or the health sector, such as face masks, the food industry sector or any other sector that requires contagion prevention measures.

The invention further contemplates functional textile products obtained with the method described in detail herein, which in addition plus it allows various images or design elements in different parts of the functional textile fabric, visually improving them; highlighting that so far there are no products with these characteristics on the market. Being able to generate designs with a central image of different colors that corresponds to the surface of, for example, a mattress, a shirt, pants or any textile product for personal use, and a perimeter print on one side and with the same or different colors; designs with an engraving in any area to the extent that it has texts, graphics and engravings in the same or different color.

The textile fabric can be made of at least one of natural fibers, such as wool, cotton, silk, miraguano, linen, hemp, jute, abaca, esparto, coconut, broom, ramie, sisal, sunn, henequen, maguey. It can also be made from at least one of artificial and synthetic fabrics, selected from acetate, alginate, cupro, modal, protein, triacetate, viscose, acrylic, chlorofiber, fluorofiber, modacrylic, polyamide or nylon, aramid, polyimide, lyocell, polylactide, polyester, polyethylene, polypropylene, polycarbamide, polyurethane, vinyl, trivinyl, elastodiene, elastane, fiberglass, elastomultiester, elastolefin, melamine, or a combination thereof. Preferably, they can be polyester microfibers.

The method for manufacturing a functional textile product with microbicidal activity is comprised of the following steps:

A first stamping step is preferred or optional for printed textile products, where said step is prior to any other treatment.

The stamping step preferably has, but is not limited to, the possibility of carrying it out in any of the following steps:

A first embodiment includes a sublimation printing process, where firstly there is a printing on paper preferably bond type and extra cellulose of 18 to 85 grams in dimensions coinciding with those of the textile fabric, where through a calender which in its interior has oil at a temperature between 205 and 215° C. and rotating at a speed that allows an exposure time of 3.4 m/min transfers the heat present in the oil and captures the image on the tissue.

Even more desired, the printing can be by digital sublimation, for which there is a system and printing of high-resolution images on woven material that employs the improved sublimation technique as described in the Mexican MX applications. 2013012016 (A) and MX 2013012017 (A).

In another embodiment, textiles made from natural fibers can undergo a direct digital printing process, where the fabric is subjected to a digital printing process through a series of digital printing machines that allows the implementation of a wide number of images, using color combinations such as black, yellow, magenta and cyan.

Particularly, the natural fibers are subjected to a vaporization step that consists of placing the fabric in an airtight space and entering hot steam with a temperature of at least 100° C., preferably at 110° C. for at least 5 min to heat set the colors.

And finally, after the vaporization step, there is a washing step, where the fabric is subjected to a washing process to remove any excess color or residual material that may be present in the printing step; during the washing step, a formulation composed of a reducing agent is used, preferably thiourea dioxide, caustic soda and a detergent, mixed with water in the following proportions: thiourea dioxide 5%, caustic soda 5% detergent 15% and water 75% where said mixture is applied at a temperature of at least 80 Celsius and in this way surplus color is removed without affecting the fabric.

Impregnation

Without intending to limit the scope of the present invention, the functional textile fabric can be absent from the stamping step, and begin with an impregnation or fouling step that consists of dipping the fabric in a nanoparticle material that gives it functionality. One of the novel aspects is that the material is applied at a temperature between 26 to 28° C., said material is preferably selected from a composite nanomaterial comprising a nanoparticulate metal oxide support, preferably titanium dioxide, which has a surface and pores, an average diameter between 1 and 100 nm and a surface area greater than or equal to 50 $m^2/g$; first functional groups chemically adsorbed on the surface of the support, and second functional groups physically adsorbed on the surface and pores of the support comprising herbal and/or fruit extracts. The process for the preparation of this nanomaterial is widely described in the Mexican patent MX 339086. The experimental evidence presented in the Mexican patent MX 339086 fully demonstrates the antimicrobial or bactericidal activity of said nanomaterial against different agents such as viruses, bacteria and even fungi.

Once the textile fabric is submerged, it is drained by means of pressure cylinders, which are specially configured to exert a pressure preferably greater than 1500 kilograms per square centimeter, even more preferably at a pressure of 3000 kilograms per square centimeter. The combination of the temperature of application of the nanoparticulate material and the pressure of the rollers allow to maintain the stability and impregnation of the nanoparticles on the textile fabric, without the use of chemical agents such as dispersants, fixatives or penetrants.

If the textile fabric has a printed image, it will be deposited and intact on the textile surface.

Drying and Fixing

Drying and fixing consists of subjecting the functional fabric, whether stamped or not, to a drying chamber that includes the arrangement of cooling means and fluid dispersion, preferably fans configured to work between 500 to 800 rpm and heat emission media configured to maintain a temperature of no more than 50° C., preferably between 45 to 48° C. to avoid damaging the functionality of the nanoparticles. Preferably, the fluid dispersion and cooling means and the heat emission means are configured to regulate the temperature in a drying chamber, in such a way that said step can be done by regulating the temperature gradually to obtain better results. in fixing different colors that can change their hue in different conditions, without compromising the functionality of the previously impregnated particles.

In a specific embodiment of the invention, the manufacture of a surgical mask, "facial mask, mask or face mask", that is to say, a particle filter medium designed to cover a portion of a subject's face, is foreseen it covers the nose and mouth, as well as the sides of the same, to contain the passage of the particles. It is widely known that surgical masks are also used by people in public spaces in the event of outbreaks or epidemics of diseases transmitted by the respiratory route, or when the air in a certain place is polluted. Simple surgical masks protect the user from being splashed into the mouth with body fluids, as well as from splashing or infecting other subjects. The use of a mask or face mask prevents the user from touching the nose and mouth, an action that could cause virus and bacteria transfers having had contact with a contaminated surface. Therefore, they reduce the spread of bacteria or virus-bearing particles generated by sneezing or coughing.

Therefore, the functional textile fabric with germicidal properties goes to a fabric cutting step, which consists of making a manual cut of each of the pieces that, to the desired size, or a fusion cut that consists of making the joint different faces or components. Finally, a manufacturing step that consists of sewing the different finishes.

In order to promote an understanding of the principles of the invention, reference will now be made to a preferred embodiment illustrated in the drawings, and specific language will be used to describe the same. However, it will be understood that it is not intended to limit the scope of the invention, such further alterations and modifications to the illustrated mask and such further applications of the principles of the invention as illustrated therein are contemplated as would normally occur now or in the future for a person skilled in the art to which the invention refers.

As shown in FIG. 1, a mask (10) is available that includes a body of generally rectangular (11) or oval shape during use, where it is made of a functional textile fabric, as has been widely described. It acts as a barrier to reduce contact with air particles, providing a breathable air supply, and it is molded to fit over a user's mouth and nose, always following the contour of the user's face. The mask (10) includes an upper portion (12) and a lower portion (13) as well as left (14) and right (15) side portions.

In a preferred embodiment, a nose clip (not shown) is used to provide additional rigid fit over the wearer's nose bridge.

As shown in the same FIG. 1, a band (16) preferably of an elongated material, more preferably a textile spring and even more preferably a spring made of a polymeric material, is incorporated at an upper point and at a lower point of each one of the left side faces shing (14) and right (15) of the mask (10) by means of a seam connection (16*a*), preferably straight type, where there is a reinforcement through a cap of between 1.2 cm and 0.2 cm, more preferably 0.7 cm and even more preferably 0.5 cm from the band (16) used.

In a preferred embodiment, a clip or other fastener (not shown) is wound around the wearer's ear as an extension so as not to injure the wearer's skin by direct contact of the band with the wearer's skin, subsequently band (16) extends towards the front of the mask (10) to be able to be joined at the top and bottom points of each of the left (14) and right (15) sides of the mask (10). It can be seen that the band (16) must be dimensioned for the user's face and/or can be adjustable to it or at least must include some excess elastic material to provide a perfect fit with the user's head. In one of the embodiments of the invention at least the end portions (17) that extend between the top and bottom of the sides of the masks have elasticity. This elasticity of the band (16) also provides enough flexibility to adapt to a variety of a user's head sizes.

On each of the sides of the mask (10) both left (14) and right (15), more specifically in the intermediate portion of each of its upper and lower parts, preferably a fold (18) is available, more preferably pleated type which in turn has a simple hem preferably made with a seam, preferably straight of at least 1.5 cm, more preferably 1.25 cm and even more preferably 1 cm Preferably, there is also a central pleat (not shown) in the middle part of the mask, having a configuration of at least two pleats, preferably three pleats and more preferably four pleats in a horizontal arrangement that aid in the accommodation of the nose and from the mouth of a user, promoting a bulky space in the middle part of the mask (10) that generates greater comfort.

Finally, and as a closure of the structure, the insertion of a hem (19) made of the same material of the mask where it is present, is preferably provided at the top and bottom of the mask (10), preferably double seam, preferably straight of at least 0.5 cm where it prevents the fibers from the mask from coming out during use and increases their life time, in addition to increasing comfort to the user in the area of the bridge of the nose, cheekbones and the lower part of the cheeks.

Figure 2:
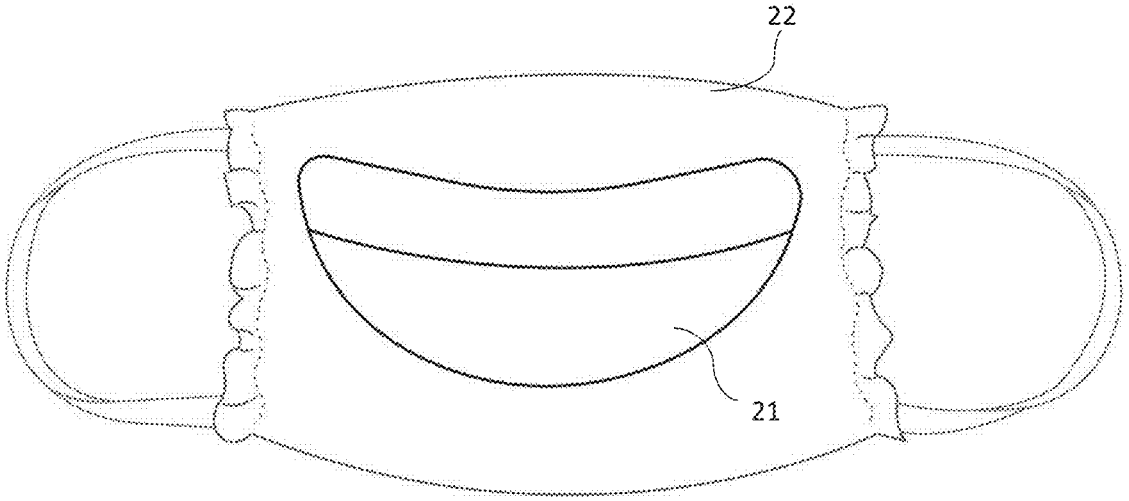
FIG. 2 shows a mask (10) with a personalized image stamped on the functionalized textile fabric.
Figure 3A:
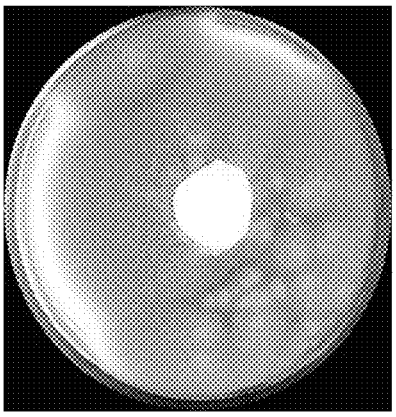
FIG. 3*a-e* show antimicrobial activity of the functional textiles of the present invention where: a) Negative control: 24 hrs.; b) Negative control: 10 days; c) 24 hour treatment; d) 48-hour treatment; and e) Treatment 10 washes with water and 48 hours of culture.
Figure 3B:
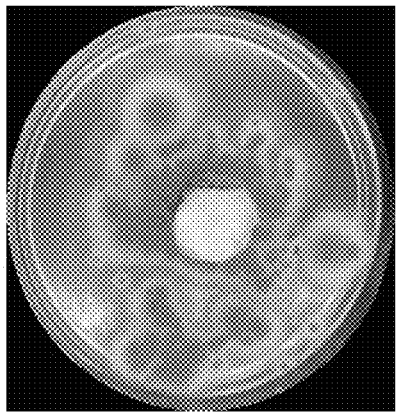
Figure 3C:
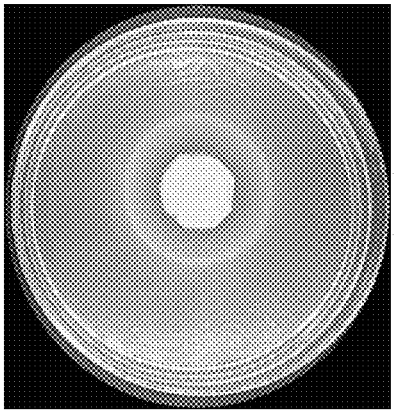
Figure 3D:
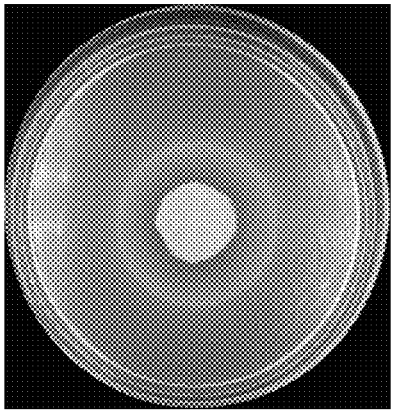
Figure 3E:
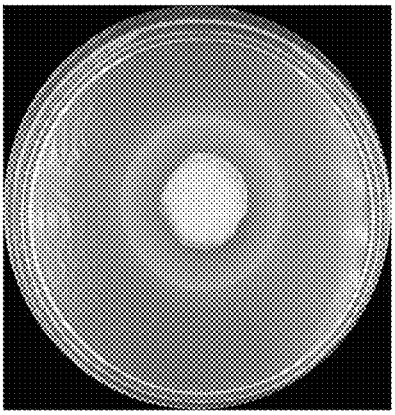

The method proposed in this specification allows to obtain functional masks with microbicidal properties, washable and with durable and sharp images or customizable texts. An example is shown in FIG. 1, which shows a text (20) arranged in an area of said mask, or FIG. 2 shows a customizable image (21) with a background of a color and design desired (22). Advantageously, the colors and functionality of the masks or any textile product obtained by the described method, last even after 10 to 15 soap-free washes.

The present example is illustrative and not limiting, as one skilled in the art will understand that there are variants that fall within the scope of protection of the present invention.

Example 1 Antimicrobial Activity of Functional Textile

To demonstrate the functional nature of the textile treated with the present invention, the treatment of a textile made of polyester microfibers was carried out to confer the antimicrobial or microbicidal functionality through a challenge with the microorganism *Aspergillus fumigatus*.

The functional textile fabric mouth masks obtained by the present invention and mouth masks of the same material without the treatment of the present invention (negative control) were sterilized by physical means, with the purpose of eliminating any contaminating microorganism. Subsequently, all the manipulations of this material were carried out in type A II biosafety cabinets to avoid contamination, and the different tests were carried out in triplicate.

Circular cutouts (1.5 cm in diameter) were taken from the functional mask and the negative control, and they were impregnated with a suspension of *Aspergillus fumigatus*, approximately 10,000 conidia in each, the cuttings were deposited in the center of a Petri dish of culture, with Sabauraud agar. Next, the plates with the samples of the face masks were incubated for 24 and 48 hours under controlled sterile conditions at 37° C. [FIG. 3 parts a) to d)].

The results show that the Petri culture box, containing the negative control, was completely colonized with the mycelium of *Aspergillus fumigatus* just 24 hours after culture, remember that the negative control corresponds to a sample of a face mask that was not treated with the present invention, and that was inoculated with *Aspergillus fumigatus*. On the contrary, the results clearly and conclusively demonstrate that the functional textiles of the present invention show their bactericidal activity at 24 and 48 hours of culture, see FIG. 3, subsections c) and d), respectively, vs the negative control of section a).

Another challenge to which the textile or functional face mask was subjected was washing, to determine if the textile retained its antimicrobial property after washing. For this purpose, the functional mouthpieces of the present invention were first subjected to 10 cycles of washing with sterile water and drying at room temperature, then impregnated with *Aspergillus fumigatus*, and cultured for 48 hrs, as previously indicated.

The results clearly and conclusively demonstrate that the functional textiles of the present invention retain their bactericidal activity after 10 cycles of washing, at 48 hours of culture, as can be seen in FIG. 3, subsection e).

Notwithstanding that the foregoing description was made taking into account the preferred embodiments of the invention, it should be borne in mind by those skilled in the art that any modification in form and detail will be within the spirit and scope of the present invention. The terms in which this report has been written should always be taken in a broad and non-limiting sense. The materials, shape and description of the elements will be subject to variation as long as it does not imply an alteration of the essential characteristic of the model.

The invention claimed is:

1. A method for manufacturing a functional textile product with microbicidal activity, the method comprising the steps of:

a) impregnating or fouling by immersing a textile material in a nanoparticle material that provides microbicidal activity at a temperature between 26 to 28° C.; subsequently passing through pressure cylinders to exert a pressure greater than 1500 kilograms per square centimeter;

b) drying and fixing by subjecting the textile material to a drying chamber having fans and heat emission devices to maintain a temperature of no more than 50° C.

2. The method for manufacturing a functional textile product with microbicidal activity according to claim 1, further including an optionally pre-stamping step including a sublimation printing process comprising a paper printing on a calender containing oil at a temperature between 205 and 215° C. and rotating at a speed to allows an exposure time of 3.4 m/min.

3. The method for manufacturing a functional textile product with microbicidal activity according to claim 1, further including a stamping step for natural fibers by direct printing, where the textile material is subjected to a digital printing process through a series of digital printing machines that allows the implementation of images, using a combination of colors selected from the group consisting of black, yellow, magenta, and cyan; subsequently, the natural fibers are subjected to a vaporization step that includes placing the fabric in an airtight space and entering hot steam with a temperature of at least 100° C. for at least 5 min, to heat set the colors; and finally a washing to remove any excess color or residual material that may be present in the stamping step.

4. The method of manufacturing a functional textile product with microbicidal activity in accordance with claim 1, wherein the nanoparticle material is a composite nanomaterial comprising a nanoparticulate metal oxide support of titanium dioxide, having a surface and pores, an average diameter between 1 and 100 nm and a surface area greater than or equal to 50 m2/g; wherein first functional groups are chemically adsorbed on the surface of the support, wherein second functional groups are physically adsorbed on the surface, and wherein the pores contain herbal and/or fruit extracts.

5. The method for manufacturing a functional textile product with microbicidal activity according to claim 1, wherein the textile fibers are made of:

at least one of natural fibers selected from the group consisting of wool, cotton, silk, miraguano, linen, hemp, jute, abaca, esparto, coconut, broom, ramie, sisal, sunn, henequen, and maguey; and at least one of artificial and synthetic fabrics; selected from the group consisting of acetate, alginate, cupro, modal, protein, triacetate, viscose, acrylic, chlorofiber, fluorofiber, modacrylic, polyamide or nylon, aramid, polyimide, lyocell, polylactide, polyester, polyethylene, polypropylene, polycarbamide, polyurethane, vinyl, trivinyl, elastodiene, elastane, fiberglass, elastomultiester, elastolefin, melamine, and combination thereof.

6. The method for manufacturing a functional textile product with microbicidal activity according to claim 1, wherein the textile fiber is made of polyester microfibers.

* * * * *